US009391398B2

(12) United States Patent
Omodachi et al.

(10) Patent No.: US 9,391,398 B2
(45) Date of Patent: Jul. 12, 2016

(54) CONNECTOR ASSEMBLY

(71) Applicants: Japan Aviation Electronics Industry, Limited, Tokyo (JP); JAE Electronics, Inc., Irvine, CA (US)

(72) Inventors: Takashi Omodachi, Tokyo (JP); Takayuki Nishimura, Tokyo (JP); Hiroaki Obikane, Tokyo (JP); Daisuke Machihara, Irvine, CA (US); Joe Motojima, Irvine, CA (US)

(73) Assignees: Japan Aviation Electronics Industry, Limited, Tokyo (JP); JAE Electronics, Inc., Irvine, CA (US)

( * ) Notice: Subject to any disclaimer, the term of this patent is extended or adjusted under 35 U.S.C. 154(b) by 0 days.

(21) Appl. No.: 14/579,479

(22) Filed: Dec. 22, 2014

(65) Prior Publication Data

US 2015/0270641 A1 Sep. 24, 2015

Related U.S. Application Data

(60) Provisional application No. 61/955,904, filed on Mar. 20, 2014.

(51) Int. Cl.

| | |
|---|---|
| ***H01R 13/629*** | (2006.01) |
| ***H01R 12/57*** | (2011.01) |
| ***H01R 12/70*** | (2011.01) |

(Continued)

(52) U.S. Cl.

CPC ..... *H01R 13/629* (2013.01); *H01R 12/57* (2013.01); *H01R 12/7005* (2013.01); *H01R 12/707* (2013.01); *H01R 12/716* (2013.01); *H01R 13/6275* (2013.01)

(58) Field of Classification Search

USPC ..... 439/74, 570, 65, 374

See application file for complete search history.

(56) References Cited

U.S. PATENT DOCUMENTS 5,259,779 A * 11/1993 Ooya et al. ..... 439/247
5,259,789 A * 11/1993 Patel et al. ..... 439/570

(Continued)

FOREIGN PATENT DOCUMENTS

EP 2 224 541 A1 9/2010
JP 2006-331679 A 12/2006

(Continued)

OTHER PUBLICATIONS

European Search Report in 15150529.4-1801, dated May 8, 2015.

(Continued)

*Primary Examiner* — Alexander Gilman
(74) *Attorney, Agent, or Firm* — Collard & Roe, P.C.

(57) ABSTRACT

A plug connector includes first contacts, a first housing comprising a guide portion and holding the first contacts, and a first metal member. The first metal member is attached to the guide portion and covers at least parts respectively of an upper surface of the guide portion and three outer surfaces of an end wall portion of the guide portion. A receptacle connector includes second contacts, a second housing holding the second contacts, and a second metal member. The second housing comprises a to-be-guided portion outside an arrangement range of the second contacts. The to-be-guided portion is adapted to be fitted to the guide portion and is formed by a U-shaped wall. The second metal member is attached to the to-be-guided portion and covers at least parts respectively of an upper surface of the to-be-guided portion and two inner surfaces of the U-shaped wall.

6 Claims, 8 Drawing Sheets

(51) Int. Cl.
*H01R 12/71* (2011.01)
*H01R 13/627* (2006.01)

(56) References Cited

U.S. PATENT DOCUMENTS

| | | | | |
|---|---|---|---|---|
| 5,928,003 | A * | 7/1999 | Kajinuma | 439/74 |
| 7,172,434 | B2 * | 2/2007 | Obikane et al. | 439/74 |
| 7,901,218 | B2 * | 3/2011 | Sato et al. | 439/74 |
| 8,083,527 | B2 * | 12/2011 | Takeuchi et al. | 439/65 |
| 8,257,095 | B2 * | 9/2012 | Akai et al. | 439/74 |
| 8,342,875 | B2 * | 1/2013 | Takeuchi | 439/374 |
| 8,398,425 | B2 * | 3/2013 | Suzuki et al. | 439/374 |
| 9,048,601 | B2 * | 6/2015 | Kimura | |
| 2004/0014335 | A1 * | 1/2004 | Igarashi et al. | 439/74 |
| 2006/0264075 | A1 | 11/2006 | Obikane et al. | |
| 2006/0276060 | A1 * | 12/2006 | Takano | 439/74 |
| 2007/0202729 | A1 * | 8/2007 | Uesaka | 439/248 |
| 2013/0280926 | A1 * | 10/2013 | Ono | 439/65 |
| 2013/0295784 | A1 | 11/2013 | Hasegawa | |

FOREIGN PATENT DOCUMENTS

| | | | |
|---|---|---|---|
| JP | 2007-258001 | A | 10/2007 |
| JP | 2010-198996 | A | 9/2010 |
| JP | 2011-065861 | A | 2/2011 |
| JP | 2013-118141 | A | 6/2013 |
| JP | 2013-206771 | A | 10/2013 |
| JP | 2013-232372 | A | 11/2013 |
| JP | 2013-232386 | A | 11/2013 |
| JP | 2014-038768 | A | 2/2014 |
| KR | 2013-0088553 | A | 8/2013 |
| KR | 10-2013-0123307 | A | 11/2013 |

OTHER PUBLICATIONS

Korean Office Action dated Mar. 9, 2016 in KR 10-2015-0020735 with English translation of relevant parts.

* cited by examiner

CONNECTOR ASSEMBLY

CROSS REFERENCE TO RELATED APPLICATIONS

Applicants claim priority under 35 U.S.C. §119 (e) and the benefit of U.S. Provisional Application Ser. No. 61/955,904 filed on Mar. 20, 2014, the disclosure of which is incorporated by reference.

TECHNICAL FIELD

This invention relates to a connector assembly comprising a receptacle connector and a plug connector.

BACKGROUND ART

As one example of a connector assembly, there is known a connector assembly comprising a receptacle connector adapted to be mounted on a circuit board and a plug connector adapted to be fittingly connected to the receptacle connector and to be mounted on another circuit board (Patent Document 1).

Referring to FIGS. 8A and 8B, a connector assembly disclosed in Patent Document 1 will be described. FIG. 8A is a perspective view showing the connector assembly comprising a plug connector 1 and a receptacle connector 2 in a state before they are fitted together. FIG. 8B is a perspective view showing the plug connector 1, shown in FIG. 8A, with its top and bottom reversed.

In FIG. 8A, the plug connector 1 and the receptacle connector 2 are circuit board connectors adapted to be respectively mounted on mounting surfaces of different circuit boards (not illustrated) and are adapted to be fitted to each other in a fitting direction which is a direction perpendicular to the mounting surfaces of the circuit boards (vertical direction in FIG. 8A).

The plug connector 1 comprises a plug housing 10 having a generally rectangular parallelepiped external shape and a plurality of plug terminals 20 held by the plug housing 10. The plurality of plug terminals 20 are held by the plug housing 10 with integral molding such that contact portions of the plug terminals 20 are arranged in one direction parallel to the mounting surface of the circuit board (not illustrated). The plurality of plug terminals 20 include a pair of signal terminals 30 held by the plug housing 10 at its middle position in the arrangement direction of the above-mentioned contact portions and a pair of power supply terminals 40 having a shape different from that of the signal terminal 30 and held by the plug housing 10 on its end sides in the arrangement direction of the above-mentioned contact portions.

The plug housing 10 is formed of an electrically insulating material such as a resin and extends in a longitudinal direction parallel to the arrangement direction of the contact portions of the plug terminals 20. The plug housing 10 has a bottom wall 11 parallel to the mounting surface of the circuit board and, as shown in FIG. 8B, a frame-like outer peripheral wall 12 extending upward (downward in FIG. 8A) from the outer peripheral portion of the bottom wall 11. The outer peripheral wall 12 is formed as a fitting portion which is fitted into a later-described receiving space 56 of the receptacle connector 2 when fitting the connectors together. The outer peripheral wall 12 has a pair of side walls 13 extending in the above-mentioned arrangement direction and a pair of end walls 14 extending in a connector width direction perpendicular to the above-mentioned arrangement direction and each connecting end portions of the pair of side walls 13 to each other.

As shown in FIG. 8B, on an outer surface of each of the pair of side walls 13, a to-be-guided groove portion 13A extending vertically is formed at a position between the signal terminal 30 and one of the pair of power supply terminals 40 in the above-mentioned arrangement direction. In the process of fitting the connectors together, the to-be-guided groove portions 13A respectively receive later-described guide elongated protrusions 54A of the receptacle connector 2 so as to be guided in the above-mentioned arrangement direction and the connector width direction by the guide elongated protrusions 54A. Further, on an outer surface of each of the pair of end walls 14, a recess 14A is formed at an intermediate position in the connector width direction. In the recess 14A, a later-described plug end plate portion 44 of the power supply terminal 40 is located. In a space forming the recess 14A, a space 14A-1 located between the end wall 14 and the plug end plate portion 44 in the above-mentioned arrangement direction is formed as a space for allowing elastic displacement of the plug end plate portion 44 in its plate thickness direction in the process of fitting the connectors together as will be described later.

In FIG. 8B, a space surrounded by the outer peripheral wall 12 and opening upward is formed as a receiving space 15 for receiving an insular projecting wall portion 52 formed in the receptacle connector 2. Further, the plug housing 10 has a to-be-guided wall portion 16 rising upward from the bottom wall 11 in the receiving space 15 at a position adjacent to the end wall 14, provided with the one of the power supply terminals 40 (the one on the left side in FIG. 8B), in the above-mentioned arrangement direction at a middle position in the connector width direction. The to-be-guided wall portion 16 has a wall thickness direction in the connector width direction and is joined to the one of the end walls 14. When fitting the connectors together, the to-be-guided wall portion 16 enters a guide groove portion 52B of the receptacle connector 2 from above so as to be guided in the above-mentioned arrangement direction and the connector width direction by the guide groove portion 52B.

As shown in FIG. 8A, the signal terminals 30 are held by the respective side walls 13 of the plug housing 10 with integral molding at its middle position in the above-mentioned arrangement direction. Each signal terminal 30 is formed by bending a belt-like piece, obtained by punching a metal plate, in its plate thickness direction. The signal terminal 30 has a straight connecting portion 31 (FIG. 8B) extending outward in the connector width direction from the side wall 13 at substantially the same height position as the bottom wall 11 of the plug housing 10 and a U-shaped portion which is bent downward continuously from the connecting portion 31 and folded back in a U-shape so as to be held by the side wall 13. This U-shaped portion extends along the side wall 13 and is exposed such that its U-shaped plate surface forms the same level surface as the side wall 13.

The connecting portion 31 is adapted to be connected by soldering to a corresponding signal circuit portion of the circuit board (not illustrated). Further, of two leg portions of the U-shaped portion of the signal terminal 30, one located on the inner surface side of the side wall 13 (the receiving space 15 side on the plug connector side) is formed as a contact portion 32 for contact with a later-described receptacle signal terminal 70 of the receptacle connector 2. The contact portion 32 is a flat plate surface exposed on the inner surface side of the side wall 13 and is adapted to be brought into contact with a corresponding contact portion 71A of the receptacle signal terminal 70. The other leg portion located on the outer surface side of the side wall 13 is formed as a locking portion 33 for engagement with a to-be-locked projection 74A of an inner leg portion 74 of the receptacle signal terminal 70. The locking portion 33 has a locking recess 33A which is adapted to receive the to-be-locked projection 74A and formed by, for example, pressing so as to be recessed from the plate surface.

As shown in FIG. 8A, the receptacle connector 2 comprises a receptacle housing 50 having a generally rectangular parallelepiped external shape and a plurality of receptacle terminals 60 held by the receptacle housing 50. The plurality of receptacle terminals 60 are held by the receptacle housing 50 with integral molding such that corresponding contact portions of the receptacle terminals 60 are arranged in one direction parallel to the mounting surface of the circuit board (not illustrated). The plurality of receptacle terminals 60 include the pair of receptacle signal terminals 70 held by the receptacle housing 50 at its middle position in the arrangement direction of the above-mentioned corresponding contact portions. The plurality of receptacle terminals 60 further include a pair of end-side receptacle terminals 80 as power supply terminals (hereinafter referred to as receptacle power supply terminals 80) having a shape different from that of the receptacle signal terminal 70 and held by the receptacle housing 50 on its end sides in the arrangement direction of the above-mentioned corresponding contact portions.

The receptacle housing 50 is formed of an electrically insulating material such as a resin and has a longitudinal direction in the arrangement direction of the corresponding contact portions of the receptacle terminals 60. The receptacle housing 50 has a bottom wall (illustration omitted) parallel to the mounting surface of the circuit board, the projecting wall portion 52 rising upward from a middle portion of this bottom wall and extending in the above-mentioned arrangement direction, and a frame-like outer peripheral wall 53 rising upward from the bottom wall and surrounding the projecting wall portion 52. The outer peripheral wall 53 has a pair of side walls 54 extending in the above-mentioned arrangement direction and a pair of end walls 55 extending in a connector width direction perpendicular to the above-mentioned arrangement direction and each connecting end portions of the pair of side walls 54 to each other. A rectangular groove-like space opening upward between the projecting wall portion 52 and the outer peripheral wall 53 is formed as the receiving space 56 for receiving the outer peripheral wall 12 which serves as the fitting portion of the plug connector 1.

As shown in FIG. 8A, the projecting wall portion 52 provided like an island on the bottom wall of the receptacle housing 50 is formed with groove portions 52A on its both side surfaces (surfaces perpendicular to the connector width direction) at the middle position in the above-mentioned arrangement direction. The groove portions 52A each provide a space for allowing elastic displacement of an elastic arm portion of the receptacle signal terminal 70 and are formed so as to be recessed from the above-mentioned both side surfaces and to extend vertically.

Each power supply terminal 40 is formed by bending a metal plate as a single member and, as shown in FIG. 8A, is held by the side walls 13 and the end wall 14 with integral molding at an end side portion, in the above-mentioned arrangement direction, of the outer peripheral wall 12 of the plug housing 10. As shown in FIG. 8B, each power supply terminal 40 has a base portion 41 extending along an upper surface (lower surface in FIG. 8A) of the end side portion of the plug housing 10 and plug side plate portions 42 bent from the base portion 41 and respectively extending along the outer surfaces of both side walls 13 of the plug housing 10. The power supply terminal 40 further has connecting portions 43 each bent at a lower end of the plug side plate portion 42 and each extending outward in the connector width direction and the plug end plate portion 44 bent from the base portion 41 and extending along an outer end surface of the end wall 14 of the plug housing 10.

As shown in FIG. 8B, the base portion 41 of the power supply terminal 40 is exposed such that a flat upper surface of the base portion 41 forms the same level surface as upper surfaces of the side walls 13 and the end wall 14 in a region except the corners of the end side portion of the plug housing 10. On the other hand, the plug side plate portion 42 is exposed such that a flat plate surface of the plug side plate portion 42 forms the same level surface as the outer surface of the side wall 13. The plug side plate portion 42 serves as a contact portion for contact with a corresponding contact portion 81A of the receptacle power supply terminal 80 provided in the receptacle connector 2.

Next, the connecting portion 43 of the power supply terminal 40 is located at substantially the same height as the bottom wall 11 (FIG. 8A) of the plug housing 10 and is adapted to be connected by soldering to a corresponding power supply circuit portion of the circuit board (not illustrated). As shown in FIG. 8B, a bent portion where the plug side plate portion 42 and the connecting portion 43 are joined together is covered with a part of the plug housing 10. Further, the plug end plate portion 44 of the power supply terminal 40 is such that its both side edge portions extending vertically are held by the plug housing 10 with integral molding in the recess 14A of the end wall 14 of the plug housing 10. A plate surface of the plug end plate portion 44 has a locking stepped portion 44A which is formed by, for example, pressing and protrudes outward in the above-mentioned arrangement direction to form a step. The locking stepped portion 44A is engageable with a to-be-locked stepped portion 82B-1 of a to-be-locked plate portion 82B of the receptacle power supply terminal 80 in a connector extraction direction.

As described above, in the connector assembly of Patent Document 1, the receptacle housing 50 of the receptacle connector 2 is formed of the resin material and has the shape in which the projecting wall portion 52 rising from the bottom wall facing the circuit board and extending in the terminal arrangement direction is surrounded by the outer peripheral wall 53 rising from the bottom wall. The rectangular groove-like space opening upward between the projecting wall portion 52 and the outer peripheral wall 53 is formed as the receiving space 56 for receiving the fitting portion of the plug connector 1. On the other hand, the plug housing 10 of the plug connector 1 is formed of the resin material and has, as the fitting portion, the outer peripheral wall 12 rising from the bottom wall 11 facing the other circuit board and having the shape conforming to the receiving space 56 of the receptacle connector 2. The outer peripheral wall 12 of the plug connector 1 has the two side walls 13 extending in the terminal arrangement direction and the two end walls 14 extending in the connector width direction perpendicular to the terminal arrangement direction and each connecting the end portions of the two side walls to each other. The groove-like space surrounded by the outer peripheral wall 12 is formed at the fitting portion of the plug connector 1.

When fitting the receptacle connector 2 and the plug connector 1 to each other, the fitting portion of the plug connector 1 is fitted into the receiving space 56 of the receptacle connector 2 from above, while the projecting wall portion 52 of the receptacle connector 2 enters the groove-like space surrounded by the fitting portion (outer peripheral wall 12) of the plug connector 1 from below.

In the meantime, as will be described in detail later, usually, guide portions are formed at both ends in a longitudinal direction of a plug connector, while to-be-guided portions for receiving the guide portions are formed at both ends in a longitudinal direction of a receptacle connector. The to-be-guided portion of the receptacle connector is called a fitting frontage portion and has a recess formed by a peripheral wall having a generally U-shape in plan view. The to-be-guided portions of the receptacle connector and the guide portions of the plug connector are each provided with a metal member for achieving a function of connecting to a power supply and a function (locking engagement) of locking the fitting of the plug connector into the receptacle connector, particularly the fitting of the guide portion into the to-be-guided portion. In terms of the connector assembly shown in FIGS. 8A and 8B, the function of locking the fitting is achieved by the locking stepped portions 44A on the plug connector 1 side and the to-be-locked stepped portions 82B-1 on the receptacle connector 2 side.

PRIOR ART DOCUMENTS

Patent Documents

Patent Document 1: JP-A-2013-232372 (FIG. 1)
Patent Document 2: JP-A-2013-232386
Patent Document 3: JP-A-2013-206771
Patent Document 4: JP-A-2006-331679

SUMMARY OF THE INVENTION

However, conventional connector assemblies have a problem in that the mechanical strengths of a to-be-guided portion of a receptacle connector and a guide portion of a plug connector are insufficient so that when insertion and extraction of the plug connector into and from the receptacle connector are repeated, at least one of the fitting frontage portion and the guide portion may be damaged.

A connector assembly according to this invention comprises a plug connector and a receptacle connector adapted to be fitted to each other along a connector fitting direction. The plug connector comprises a plurality of first contacts, a first housing holding the plurality of first contacts arranged along a terminal arrangement direction, and a first metal member disposed outside an arrangement range of the plurality of first contacts in the first housing. The first housing comprises a guide portion outside the arrangement range of the plurality of first contacts and the first metal member is attached to the guide portion. The first metal member covers at least parts respectively of an upper surface in the connector fitting direction of the guide portion and three outer surfaces of an end wall portion of the guide portion. The receptacle connector comprises a plurality of second contacts, a second housing holding the plurality of second contacts arranged along a terminal arrangement direction, and a second metal member disposed outside an arrangement range of the plurality of second contacts in the second housing. The second housing comprises a to-be-guided portion outside the arrangement range of the plurality of second contacts and the second metal member is attached to the to-be-guided portion. The to-be-guided portion is adapted to be fitted to the guide portion and is formed by a wall of a U-shape as seen in the connector fitting direction. The second metal member covers at least parts respectively of an upper surface in the connector fitting direction of the to-be-guided portion and two inner surfaces, facing each other, of the U-shape.

According to this invention, a guide portion in a first housing of a plug connector is configured such that at least parts of an upper surface in a connector fitting direction of the guide portion and three outer surfaces of an end wall portion of the guide portion are covered with a first metal member, while a to-be-guided portion in a second housing of a receptacle connector is configured such that at least parts of an upper surface in the connector fitting direction of the to-be-guided portion and two inner surfaces, facing each other, of the to-be-guided portion are covered with a second metal member. Therefore, it is possible to enhance the strength and durability of the guide portion in the plug connector and the to-be-guided portion in the receptacle connector and thus it is possible to provide a connector assembly that is hardly damaged even when the plug connector is fitted into the receptacle connector at an offset position.

DESCRIPTION OF THE EMBODIMENTS

Hereinbelow, an embodiment of this invention will be described with reference to the accompanying drawings.

Figure 1:
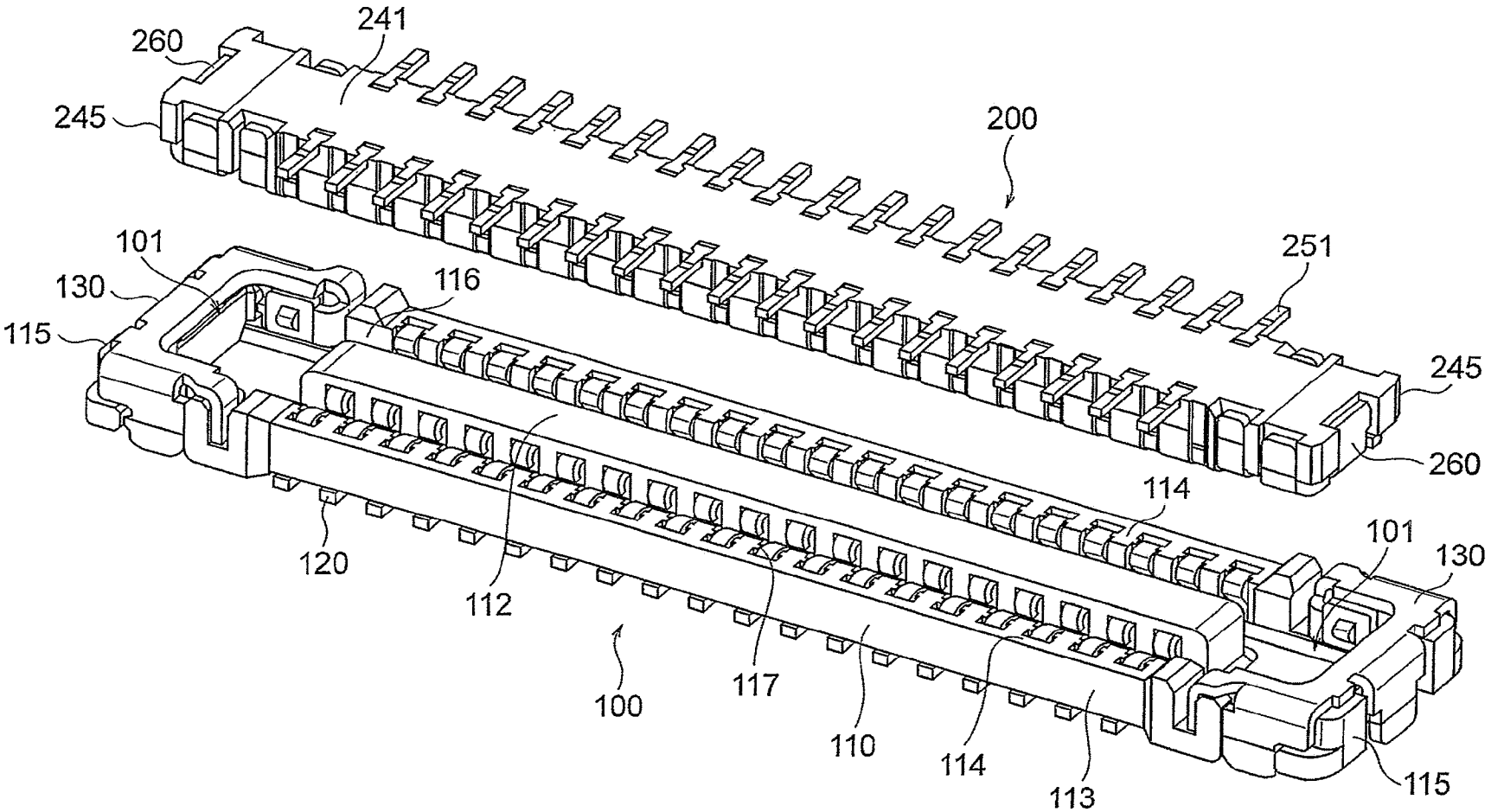
FIG. 1 is a perspective view showing an entire receptacle connector and an entire plug connector in postures just before fitting both connectors together, according to an embodiment of this invention.
Figure 2:
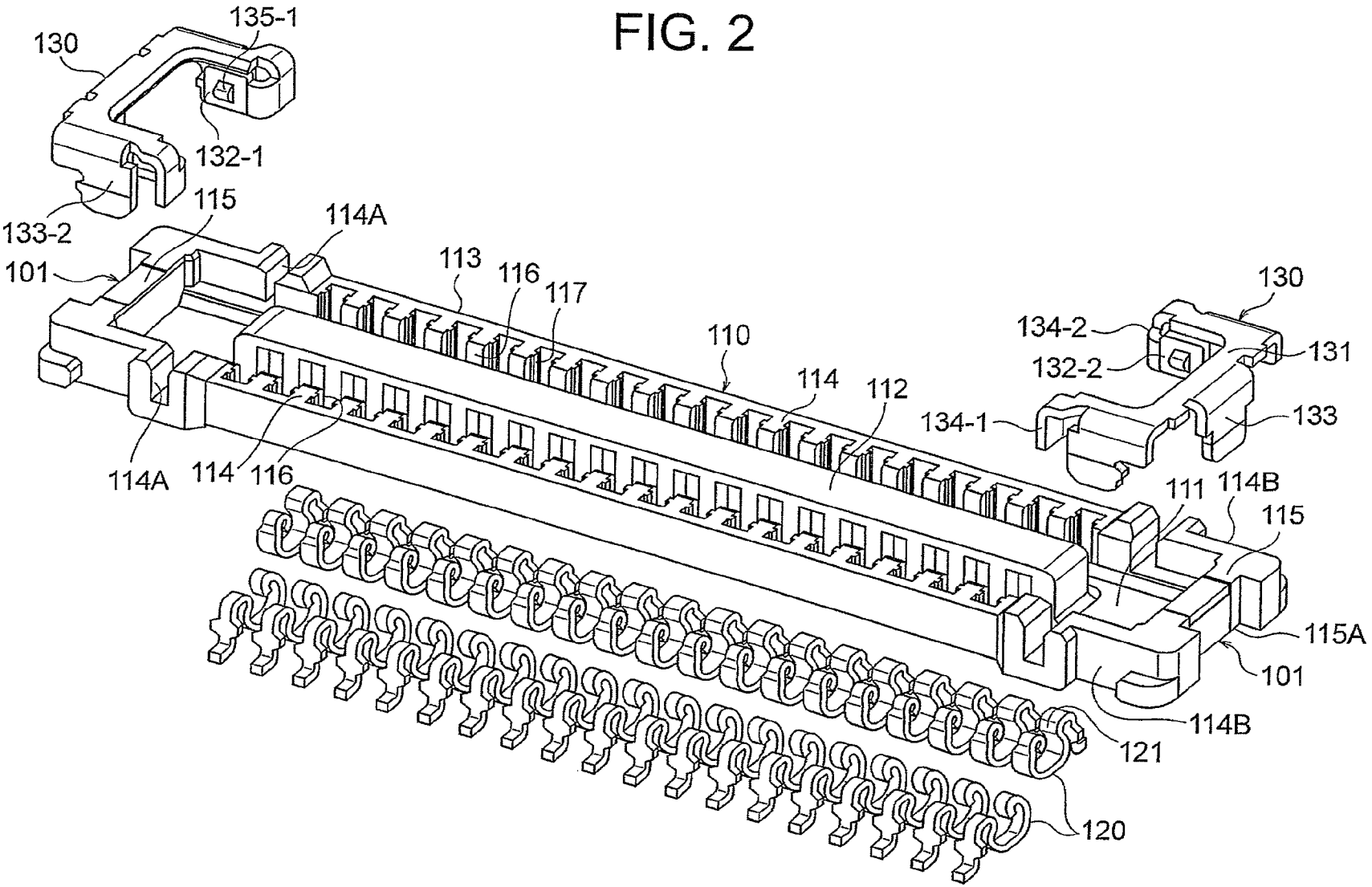
FIG. 2 is an exploded perspective view of the receptacle connector of FIG. 1.
Figure 5:
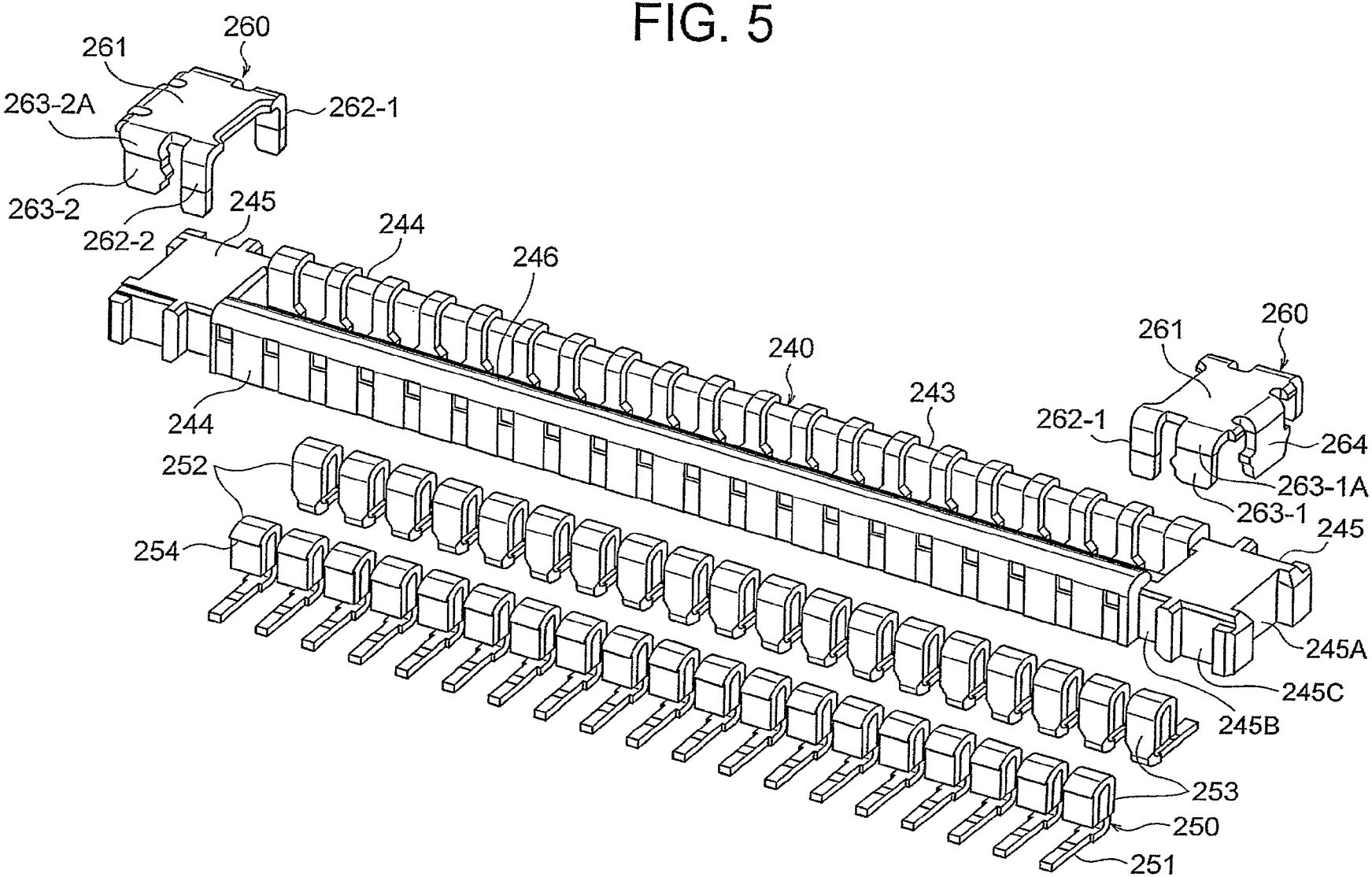
FIG. 5 is an exploded perspective view of the plug connector of FIG. 1.
Figure 6A:
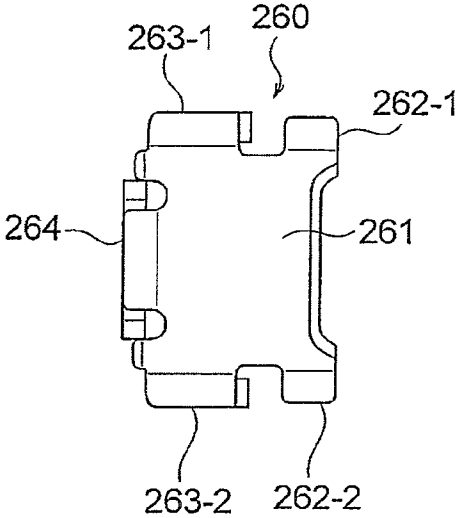
FIG. 6A is a plan view of a plug metal fitting shown in FIG. 5.
Figure 6B:
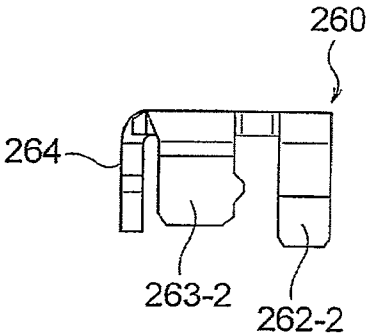
FIG. 6B is a side view thereof.
Figure 6C:
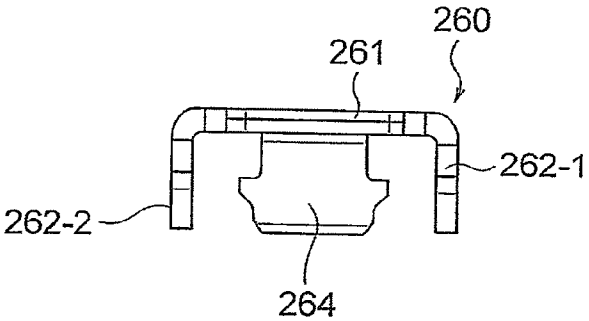
FIG. 6C is a front view thereof.
Figure 6D:
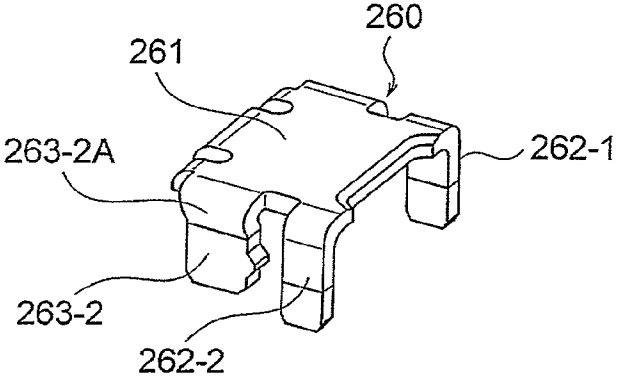
FIGS. 6D and 6E are perspective views thereof.
Figure 6E:
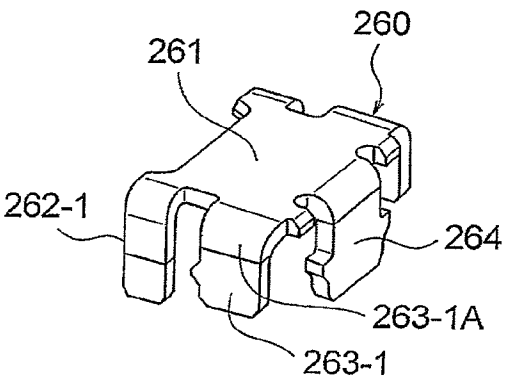

FIG. 1 is a perspective view showing an entire receptacle connector and an entire plug connector in postures just before fitting both connectors together, according to the embodiment of this invention. In FIG. 1, the receptacle connector is shown in a posture with its receiving space facing upward, while the plug connector is shown in a posture with its receiving space facing downward. FIG. 2 is an exploded perspective view of the receptacle connector of FIG. 1. FIG. 5 is an exploded perspective view of the plug connector of FIG. 1, wherein the plug connector is shown in a posture with its receiving space facing upward.

A receptacle connector 100 and a plug connector 200 in this embodiment are circuit board connectors adapted to be mounted on different circuit boards (not illustrated) and form a connector assembly having a connector fitting (insertion and extraction) direction in a direction (vertical direction in FIG. 1) perpendicular to surfaces of the circuit boards.

First, the receptacle connector 100 will be described. The receptacle connector 100 is adapted to be mounted on the circuit board in the posture shown in FIG. 1. As shown in FIGS. 1 and 2, the receptacle connector 100 comprises a receptacle housing (second housing) 110 having a generally rectangular parallelepiped external shape, a plurality of receptacle terminals (second contacts) 120 held by the receptacle housing 110 and arranged in two rows in a terminal arrangement direction which is a longitudinal direction of the receptacle housing 110, and two receptacle metal fittings (second metal members) 130 attached to wall portions constituting fitting frontage portions (to-be-guided portions) 101 formed at both end portions in the longitudinal direction of the receptacle housing 110.

The receptacle housing 110 is formed of an electrically insulating material such as a resin and extends in the longitudinal direction (terminal arrangement direction) which is a direction parallel to the mounting surface (not illustrated) of the circuit board. The receptacle housing 110 has a bottom wall 111 parallel to the above-mentioned mounting surface, a projecting wall portion 112 rising upward from the bottom wall 111 and extending in the terminal arrangement direction, and a frame-like outer peripheral wall 113 rising upward from the bottom wall 111 and surrounding the projecting wall portion 112. The outer peripheral wall 113 has a pair of side walls 114 extending in the terminal arrangement direction and a pair of end wall portions 115 extending in a direction (connector width direction) perpendicular to the terminal arrangement direction and each connecting end portions of the pair of side walls 114 to each other. Since the extending length of the projecting wall portion 112 is shorter than the length of the side wall 114, recesses are formed between both ends of the projecting wall portion 112 and the end wall portions 115 and this recess serves as a part of each fitting frontage portion 101. In other words, the recess serving as the part of the fitting frontage portion 101 is formed on the inner side of the outer peripheral wall of a generally U-shape, as seen in the connector fitting direction (in FIG. 2, from the upper side which is the side of fitting with the plug connector 200), formed by the end wall portion 115 of the receptacle housing 110 and parts of the two side walls 114 extending in parallel to each other from the end wall portion 115. That is, in this embodiment, the recess and the generally U-shaped outer peripheral wall jointly serve as the to-be-guided portion 101 (fitting frontage portion 101) of the receptacle connector 100. A rectangular groove-like space opening upward between the projecting wall portion 112 and the outer peripheral wall 113 serves as a receiving space 116 for receiving an outer peripheral wall 243 (see FIG. 5) as a fitting portion of the plug connector 200.

In the receptacle housing 110, a plurality of terminal holding grooves 117 for holding the receptacle terminals 120 are arranged at regular intervals in the terminal arrangement direction and symmetrically arranged in two rows with the projecting wall portion 112 interposed therebetween. Each terminal holding groove 117 continuously extends over a side surface of the projecting wall portion 112, an upper surface of the bottom wall 111, and an inner surface (surface facing the side surface of the projecting wall portion 112) of the side wall 114. The receptacle metal fittings 130 are attached to the outer peripheral wall 113 at its portions forming the fitting frontage portions 101 at both end portions in the terminal arrangement direction of the receptacle housing 110, i.e. on the outer sides of the terminal arrangement range in the receptacle housing 110.

In this embodiment, as described above, the part, located outside the terminal arrangement range in the terminal arrangement direction, of the receiving space 116 in the form of the rectangular groove-like space, i.e. the end wall portion 115 and the parts of the two side walls 114 of the receptacle housing 110 and the space surrounded by them, is defined as the fitting frontage portion 101.

Next, referring to FIGS. 3A to 3E in addition to FIGS. 1 and 2, the receptacle metal fitting (second metal member) 130 will be described. The receptacle metal fitting 130 comprises a single metal plate member and is formed by punching and bending so that it can cover a part of the outer peripheral wall 113, constituting the fitting frontage portion 101, of the receptacle housing 110. The receptacle metal fitting 130 not only serves for electrical connection, but also serves as a reinforcing metal fitting for reinforcing the receptacle housing 110, particularly the fitting frontage portion 101.

This will be described in detail. The receptacle metal fitting 130 in this embodiment has an upper surface portion 131 for covering upper surfaces in the connector fitting direction (in FIG. 2, upper surfaces being the side of fitting with the plug connector 200) of the end wall portion 115 and the two side walls 114, constituting the fitting frontage portion 101, of the receptacle housing 110 and inner surface portions 132-1 and 132-2 for covering two inner surfaces, facing each other, of the two side walls 114. The receptacle metal fitting 130 further has an end surface portion 133 and outer surface portions 133-1 and 133-2 for respectively covering at least parts of an outer end surface of the end wall portion 115 and outer surfaces of the two side walls 114. The receptacle metal fitting 130 further has two fitting portions 134-1 and 134-2 that are fitted into grooves 114A formed in the two side walls 114, located outside the terminal arrangement range, and extending in the connector width direction. The end surface portion 133, the outer surface portions 133-1 and 133-2, and the fitting portions 134-1 and 134-2 are respectively formed by bending so that these portions extend downward (in the connector fitting direction toward the lower side from the upper side which is the side of fitting with the plug connector 200) from edge portions of the upper surface portion 131. The outer end surface of the end wall portion 115 and the outer surfaces of the two side walls 114 are respectively formed with recesses (receiving portions) 115A and 114B for receiving the end surface portion 133 and the outer surface portions 133-1 and 133-2 of the receptacle metal fitting 130. By this, the end surface portion 133 of the receptacle metal fitting 130 is prevented from protruding from the outer end surface of the end wall portion 115 and the outer surface portions 133-1 and 133-2 of the receptacle metal fitting 130 are prevented from protruding from the outer surfaces of the two side walls 114.

Figure 3A:
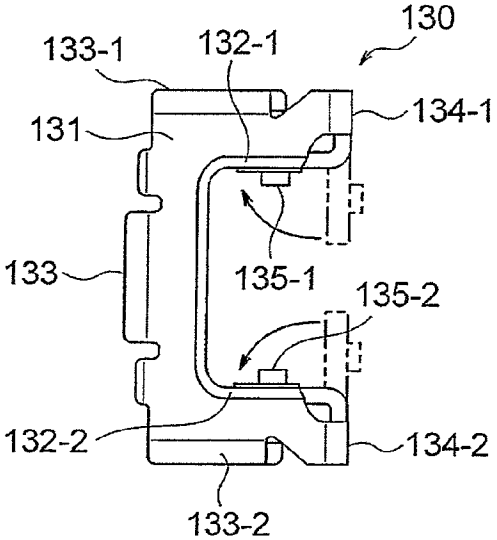
FIG. 3A is a plan view of a receptacle metal fitting shown in FIG. 2.
Figure 3B:
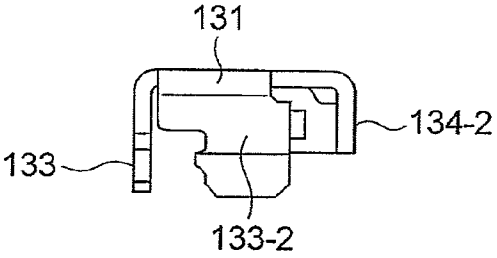
FIG. 3B is a side view thereof.
Figure 3C:
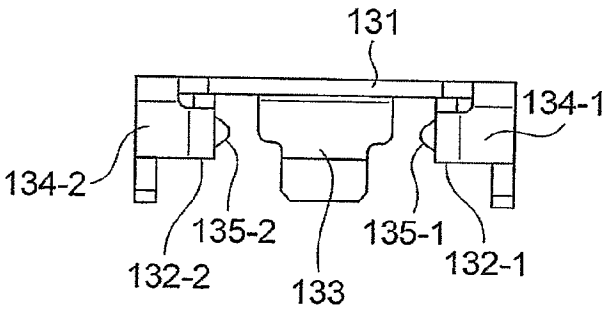
FIG. 3C is a front view thereof.
Figure 3D:
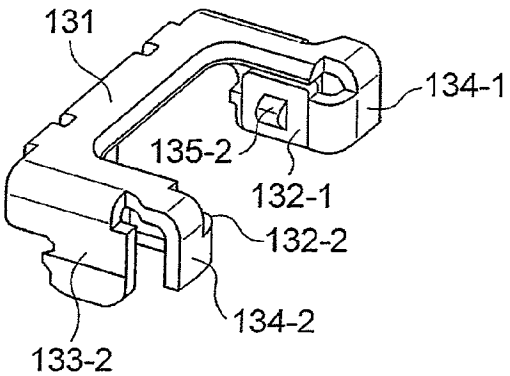
FIGS. 3D and 3E are perspective views thereof.
Figure 3E:
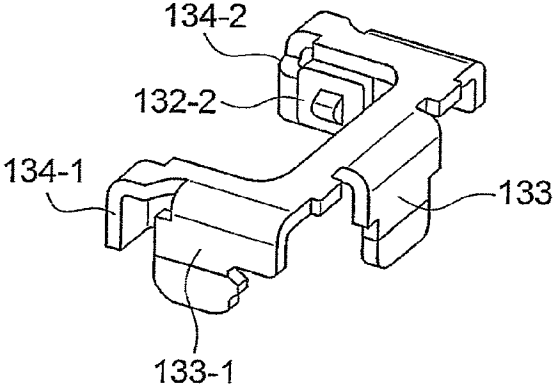
Figures 4A, 4B, 4C, 4D:
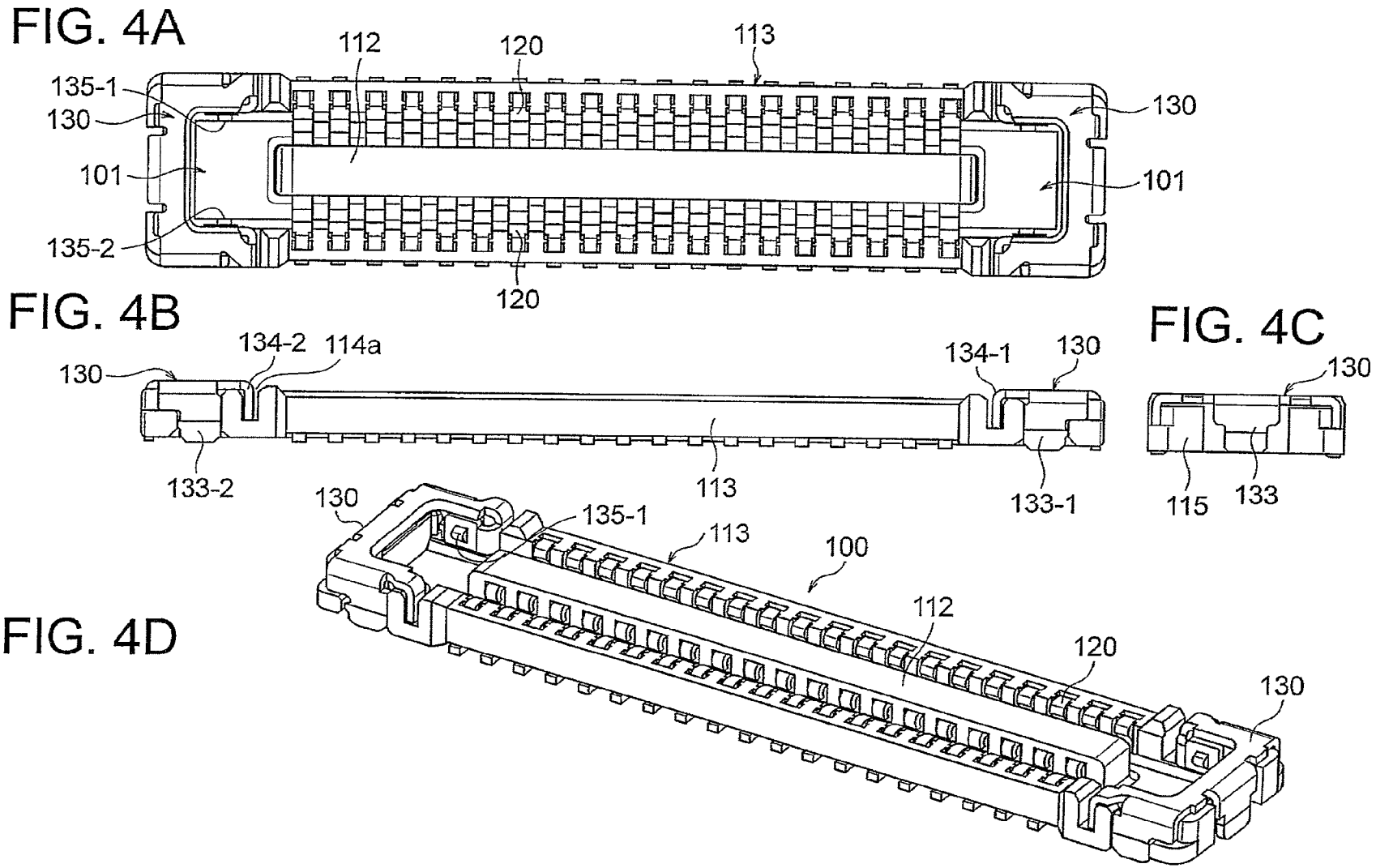
FIG. 4A is a plan view of the receptacle connector of FIG. 1.
FIG. 4B is a side view thereof.
FIG. 4C is a front view thereof.
FIG. 4D is a perspective view thereof.

On the other hand, the inner surface portions 132-1 and 132-2 are formed so as not to extend downward from edge portions of the upper surface portion 131, but to extend from inner side edge portions, facing each other, of the fitting portions 134-1 and 134-2 toward the end surface portion 133 side. This is for facilitating the displacement of the inner surface portions 132-1 and 132-2 in the connector width direction (direction perpendicular to plate surfaces thereof), thereby allowing the inner surface portions 132-1 and 132-2 to easily exhibit the springiness in the connector width direction. For this, as shown in FIG. 3A, the inner surface portions 132-1 and 132-2 continuing from the side edge portions of the fitting portions 134-1 and 134-2 are each bent at 90 degrees toward the end surface portion 133 side from a position indicated by a broken line. Further, on surfaces, facing each other, of the inner surface portions 132-1 and 132-2, projections 135-1 and 135-2 for locking are formed by cutting and raising or the like so as to protrude on the surface sides. Herein, locking represents locking the fitting of the plug connector 200 into the receptacle connector 100, particularly the fitting of a guide portion 245 of the plug connector 200 into the fitting frontage portion (to-be-guided portion) 101 of the receptacle connector 100. In order to impart the springiness to the inner surface portions 132-1 and 132-2, the inner surface portions 132-1 and 132-2 should be displaceable in the connector width direction even after the receptacle metal fitting 130 is attached to the receptacle housing 110 (fitting frontage portion 101). Therefore, the inner surface portions 132-1 and 132-2 are formed so as to be slightly spaced apart from the inner surfaces of the side walls 114 even after the receptacle metal fitting 130 is attached to the receptacle housing 110 (fitting frontage portion 101).

The receptacle metal fitting 130 thus formed is attached, by press fitting, to the parts of the two side walls 114 and the end wall portion 115 constituting the fitting frontage portion 101.

FIGS. 4A, 4B, 4C, and 4D are respectively a plan view, a side view, a front view, and a perspective view showing the receptacle connector 100 after the receptacle metal fittings 130 are attached by press fitting. The end surface portions 133 and the outer surface portions 133-1 and 133-2 of the receptacle metal fittings 130 are used as terminals for connection to a power supply or the like (not illustrated) on the circuit board side. The inner surface portions 132-1 and 132-2 and the projections 135-1 and 135-2 of the receptacle metal fittings 130 are used for electrical connection to the plug connector 200 side and for locking the fitting with the plug connector 200. The locking will be described later.

Next, referring to FIGS. 1 and 5, the plug connector 200 will be described.

FIG. 1 shows the plug connector 200 with its top and bottom reversed. This is because the plug connector 200 is fitted into the receptacle connector 100, with its receiving space facing downward.

The plug connector 200 comprises a plug housing (first housing) 240 having a generally rectangular parallelepiped external shape and a plurality of plug terminals (first contacts) 250 in two rows held by the plug housing 240 and arranged at regular intervals in a longitudinal direction (terminal arrangement direction) of the plug housing 240. The plug connector 200 further comprises two plug metal fittings (first metal members) 260 attached to both end portions in the longitudinal direction of the plug housing 240. The plug metal fitting 260 not only serves for electrical connection, but also serves as a reinforcing metal fitting for reinforcing the plug housing 240. The plug connector 200 is adapted to be mounted, at its upper surface shown in FIG. 1, on the circuit board and, in this posture, adapted to be fittingly connected to the receptacle connector 100 as a mating connector.

The plug housing 240 is formed of an electrically insulating material such as a resin and extends in the longitudinal direction (terminal arrangement direction) which is a direction parallel to the mounting surface (not illustrated) of the circuit board. The plug housing 240 has a bottom wall 241 (see FIG. 1) parallel to the above-mentioned mounting surface and, as shown in FIG. 5, a frame-like outer peripheral wall 243 as a fitting portion rising upward (in the connector fitting direction toward the upper side which is the side of fitting with the receptacle connector 100) from the bottom wall 241. The outer peripheral wall 243 has a pair of side walls 244 extending in the terminal arrangement direction and a pair of end wall portions (guide portions) 245 extending in a connector width direction perpendicular to the terminal arrangement direction and each connecting end portions of the pair of side walls 244 to each other. In this embodiment, the end wall portion 245 itself serves as the guide portion 245 of the plug connector 200. A space surrounded by the outer peripheral wall 243 and opening upward serves as a receiving space 246 for receiving the projecting wall portion 112 of the receptacle connector 100.

Figure 7A:
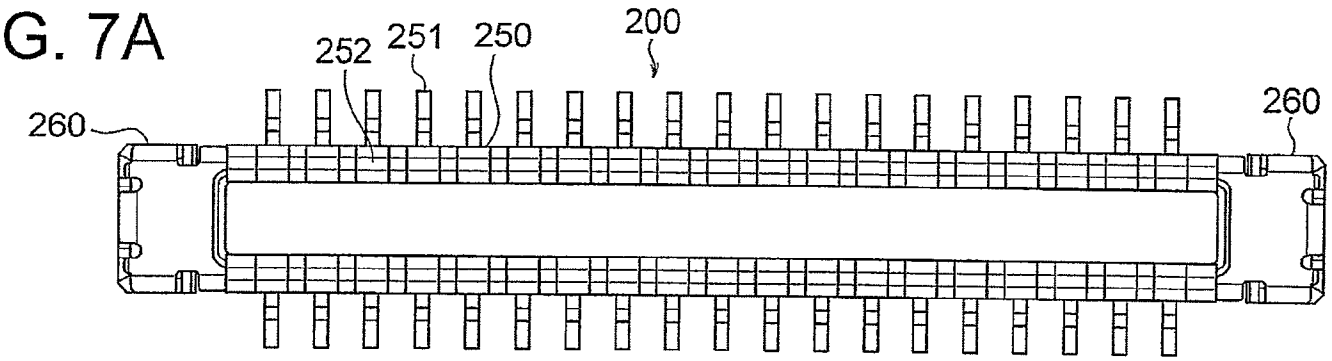
FIG. 7A is a plan view of the plug connector of FIG. 1.
Figure 7B:
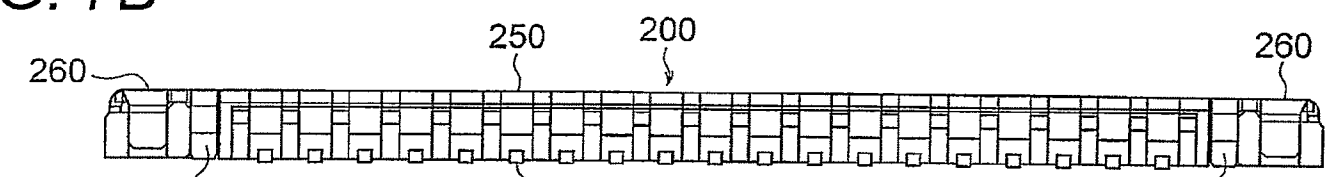
FIG. 7B is a side view thereof.
Figure 7C:
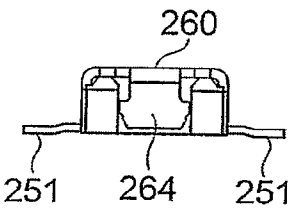
FIG. 7C is a front view thereof.
Figure 7D:
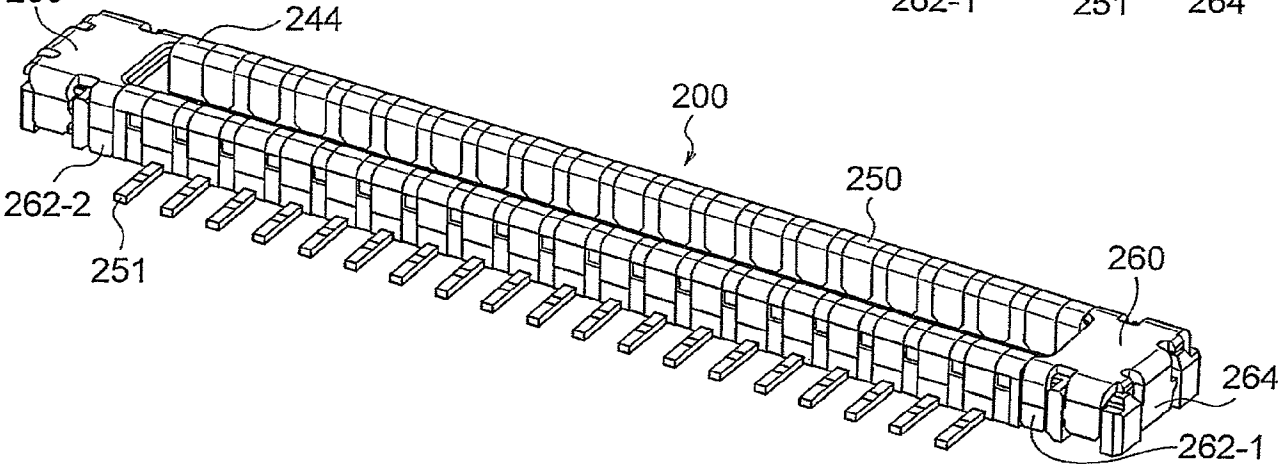
FIG. 7D is a perspective view thereof.
Figure 8B:
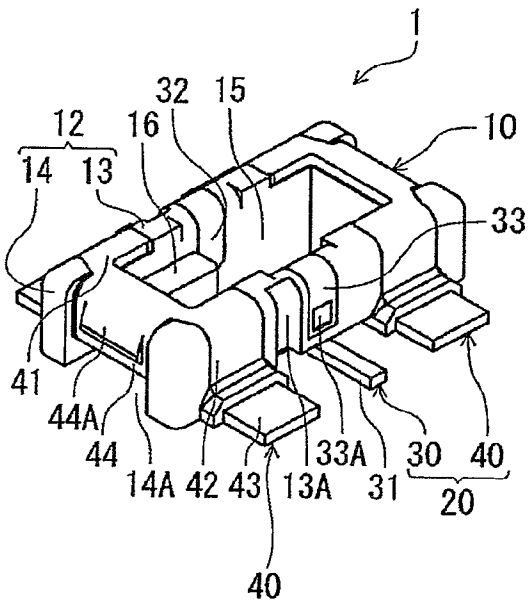
FIG. 8B is a perspective view showing the plug connector, shown in FIG. 8A, with its top and bottom reversed.
Figure 8A:
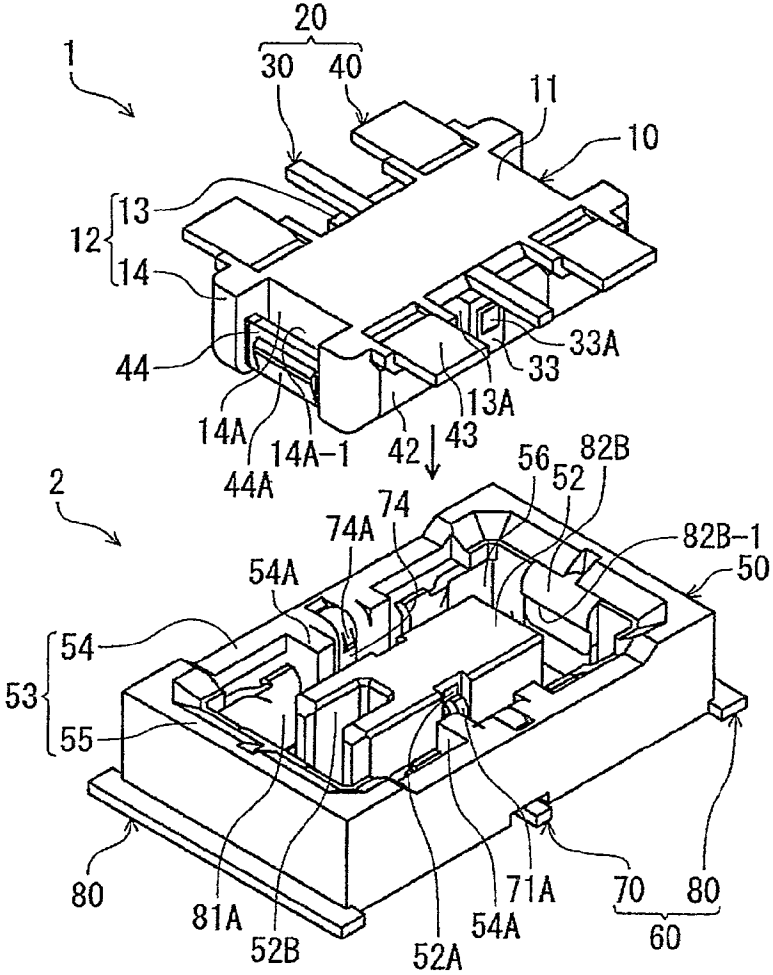
FIG. 8A is a perspective view showing a known connector assembly comprising a plug connector and a receptacle connector in a state before they are fitted together.

Each plug terminal 250 is formed by bending a belt-like piece, obtained by punching a metal plate, in its plate thickness direction. The plug terminals 250 are held by the two side walls 244 of the plug housing 240 with integral molding or press fitting and are arranged at regular intervals in a longitudinal direction of the side walls 244. Each plug terminal 250 has a connecting portion 251 protruding outward in the connector width direction from the side wall 244 at substantially the same height position as the bottom wall 241 of the plug housing 240 and an inverse U-shaped portion 252 which is bent upward in FIG. 5 (in the connector fitting direction toward the upper side which is the side of fitting with the receptacle connector 100) continuously from the connecting portion 251 and folded back in an inverse U-shape so as to be held by the side wall 244. As shown in FIGS. 7A and 7D, the inverse U-shaped portion 252 extends along the side wall 244 and is exposed such that its inverse U-shaped plate surface forms the same surface as that of the side wall 244.

Of two leg portions of the inverse U-shaped portion 252 of the plug terminal 250, one located on the inner surface side of the side wall 244 serves as a contact portion 253 for contact with the receptacle terminal 120 (see FIG. 1) of the receptacle connector 100. Of the two leg portions of the inverse U-shaped portion 252, the other located on the outer surface side of the side wall 244 is formed near its upper end with a projection extending in the longitudinal direction. This projection serves as an engaging portion 254 for engagement with a locking projection 121 (see FIG. 2) of the receptacle terminal 120.

Next, referring to FIGS. 6A to 6D in addition to FIGS. 1 and 5, the plug metal fitting 260 will be described. As shown in FIG. 5, the plug metal fitting 260 has an upper surface portion 261 and is attached, by press fitting, to the end wall portion (guide portion) 245 formed outside the terminal arrangement range in the plug housing 240. However, as shown in FIG. 1, when the plug connector 200 is fittingly connected to the receptacle connector 100, the upper surface portion of the plug metal fitting 260 is directed downward. The plug metal fitting 260 serves for electrical connection to a power supply through the circuit board and, in addition, when the plug connector 200 is fittingly connected to the receptacle connector 100, the plug metal fitting 260 is fitted into the recess of the fitting frontage portion 101 in the receptacle connector 100, thereby achieving electrical connection and locking to the receptacle metal fitting 130.

The plug metal fitting 260 comprises a single metal plate member and is formed by punching and bending so that it can cover at least parts of an upper surface and side surfaces of the end wall portion 245 formed at each of both end portions of the plug housing 240. This will be described in detail. The plug metal fitting 260 in this embodiment has the upper surface portion 261 for covering an upper surface in the connector fitting direction (upper surface being the side of fitting with the receptacle connector 100) of the end wall portion 245 in the plug housing 240. The plug metal fitting 260 further has first outer surface portions (outer surface portions) 262-1 and 262-2 for covering two outer surfaces, on the sides opposite to each other, of the end wall portion 245 at a first position and second outer surface portions (outer surface portions) 263-1 and 263-2 for covering those two outer surfaces at a second position which differs from the first position in the longitudinal direction (terminal arrangement direction). The plug metal fitting 260 further has an end surface portion 264 for covering at least a part of an outer end surface of the end wall portion 245. The first outer surface portions 262-1 and 262-2, the second outer surface portions 263-1 and 263-2, and the end surface portion 264 are respectively formed by bending so that these portions extend downward (in the connector fitting direction toward the lower side from the upper side which is the side of fitting with the receptacle connector 100) from edge portions of the upper surface portion 261. The outer end surface of the end wall portion 245 and the two outer surfaces, on the sides opposite to each other, of the end wall portion 245 are respectively formed with recesses (receiving portions) 245A, 245B, and 245C for receiving the end surface portion 264, the first outer surface portions 262-1 and 262-2, and the second outer surface portions 263-1 and 263-2 of the plug metal fitting 260. By this, the end surface portion 264 of the plug metal fitting 260 is prevented from protruding from the outer end surface of the end wall portion 245 and the first outer surface portions 262-1 and 262-2 and the second outer surface portions 263-1 and 263-2 of the plug metal fitting 260 are prevented from protruding from the outer surfaces of the end wall portion 245.

When the receptacle connector 100 and the plug connector 200 are fittingly connected together, the second outer surface portions 263-1 and 263-2 face the inner surface portions 132-1 and 132-2 of the receptacle metal fitting 130 shown in FIG. 2. Projections 263-1A and 263-2A extending in the terminal arrangement direction are provided on outer surfaces of the second outer surface portions 263-1 and 263-2 at positions close to the upper surface portion 261. By this, it is configured such that when the receptacle connector 100 and the plug connector 200 are fittingly connected together, the projections 263-1A and 263-2A, jointly with the locking projections 135-1 and 135-2 formed on the inner surface portions 132-1 and 132-2 of the receptacle metal fitting 130, can lock the fitting of the plug connector 200 into the receptacle connector 100, particularly the fitting of the guide portion of the plug connector into the to-be-guided portion of the receptacle connector 100. This locking will be described later.

The plug metal fitting 260 thus formed is attached, by press fitting, to the end wall portion 245 of the plug housing 240. While the first outer surface portion 262-1 and the second outer surface portion 263-1 are formed separately from each other and the first outer surface portion 262-2 and the second outer surface portion 263-2 are formed separately from each other, they may be integrally formed into a single plate.

FIGS. 7A, 7B, 7C, and 7D are respectively a plan view, a side view, a front view, and a perspective view showing the plug connector 200 after the plug metal fittings 260 are attached. The first outer surface portions 262-1 and 262-2 and the end surface portions 264 of the plug metal fittings 260 are used as terminals for electrical connection to a power supply or the like (not illustrated) on the circuit board side. The second outer surface portions 263-1 and 263-2 of the plug metal fittings 260 are used for electrical connection to the receptacle metal fittings 130 and for locking the fitting of the plug connector 200 into the receptacle connector 100, particularly the fitting of the guide portions 245 of the plug connector into the to-be-guided portions 101 of the receptacle connector 100.

Next, the fitting of the plug connector 200 into the receptacle connector 100, particularly the locking of the plug connector 200 after the plug connector 200 is fitted into the receptacle connector 100, will be described. Incidentally, since the connection between the receptacle terminals 120 and the plug terminals 250 caused by the fitting connection between the receptacle connector 100 and the plug connector 200 has nothing to do with the gist of this invention, a description thereof will be omitted.

When the plug connector 200 is moved downward from the state shown in FIG. 1 so that the end wall portions (guide portions) 245 are fitted into the fitting frontage portions 101 of the receptacle connector 100, the projections 263-1A and 263-2A of the second outer surface portions 263-1 and 263-2 of the plug metal fittings 260 abut against the locking projections 135-1 and 135-2 of the inner surface portions 132-1 and 132-2 of the receptacle metal fittings 130. When the plug connector 200 is further lowered, this push-down force becomes a force in a direction (connector width direction) perpendicular to the surfaces of the inner surface portions 132-1 and 132-2 through the projections 263-1A and 263-2A and the projections 135-1 and 135-2 and acts on the inner surface portions 132-1 and 132-2. As a result, the inner surface portions 132-1 and 132-2 are displaced away from each other. However, immediately after the projections 263-1A and 263-2A pass through the projections 135-1 and 135-2, the inner surface portions 132-1 and 132-2 return to their initial positions due to the springiness thereof. The plug connector 200 is pushed into the receptacle connector 100 until the upper surface portions 261 of the plug metal fittings 260 abut against or approach the bottom surfaces of the recesses of the fitting frontage portions 101. This state is a so-called locked state where the locking projections 135-1 and 135-2 are in engagement with the projections 263-1A and 263-2A to prevent the end wall portions 245 (guide portions) from coming out of the fitting frontage portions 101 (to-be-guided portions). Naturally, if an attempt is made to pull out the entire plug connector 200 with a predetermined or greater pulling force that can displace the inner surface portions 132-1 and 132-2, the plug connector 200 can be pulled out of the receptacle connector 100.

(Effect of the Embodiment)

As described above, in the embodiment of this invention, the end wall portions (guide portions) 245 in the plug housing 240 of the plug connector 200 are each such that the upper surface in the connector fitting direction (upper surface being the side of fitting with the receptacle connector 100) of the end wall portion 245 is covered with the upper surface portion 261 of the plug metal fitting 260, while the three outer surfaces of the side wall of the end wall portion 245 are covered with the pair of first outer surface portions 262-1 and 262-2, the pair of second outer surface portions 263-1 and 263-2, and the end surface portion 264. On the other hand, the fitting frontage portions (to-be-guided portions) 101 in the receptacle housing 110 of the receptacle connector 100 are each such that the upper surface in the connector fitting direction (upper surface being the side of fitting with the plug connector 200) of the fitting frontage portion 101 is covered with the upper surface portion 131 of the receptacle metal fitting 130, while the two inner surfaces, facing each other, of the generally U-shaped side wall constituting the fitting frontage portion 101 are covered with the pair of inner surface portions 132-1 and 132-2 of the receptacle metal fitting 130 and the three outer surfaces of the generally U-shaped side wall are covered with the end surface portion 133 and the pair of outer surface portions 133-1 and 133-2. By this, it is possible to enhance the strength and durability of the end wall portions (guide portions) 245 in the plug connector 200 and the fitting frontage portions (to-be-guided portions) 101 in the receptacle connector 100 and thus it is possible to provide a connector assembly that is hardly damaged even when the plug connector 200 is fitted into the receptacle connector 100 at an offset position.

A conventional connector assembly is configured such that a locking engagement portion is formed at each of both end portions in a longitudinal direction of a receptacle connector, i.e. on an end wall of a generally U-shaped peripheral wall (a wall corresponding to the bottom of the U-shape), thereby locking the fitting of a plug connector. Besides, power supply connecting portions are formed, at each of both end portions in the longitudinal direction of the receptacle connector, in a direction perpendicular to the longitudinal direction of the receptacle connector, i.e. on side walls of the generally U-shaped peripheral wall (side walls corresponding to two leg portions of the U-shape). A problem has been pointed out that, with such a structure, the plug connector tends to be inclined by the application of force caused by oblique extraction of the plug connector (extraction of extracting only one of two side walls of the plug connector).

For such a problem, in the embodiment of this invention, the springiness is imparted to the inner surface portions 132-1 and 132-2 of the receptacle metal fitting 130 that cover the two inner surfaces, facing each other, of the generally U-shaped side wall constituting the fitting frontage portion 101 (to-be-guided portion) and, further, the projections 135-1 and 135-2 are provided on the inner surface portions 132-1 and 132-2. Besides, the second outer surface portions 263-1 and 263-2 of the plug metal fitting 260 that face the inner surface portions 132-1 and 132-2 when the plug connector 200 is fittingly connected to the receptacle connector 100 are provided with the projections 263-1A and 263-2A that, jointly with the projections 135-1 and 135-2 of the receptacle metal fitting 130, prevent coming-off of the guide portion of the plug connector 200. Furthermore, the power supply connecting portions in the receptacle metal fitting 130 are realized by the pair of outer surface portions 133-1 and 133-2, while the power supply connecting portions in the plug metal fitting 260 are realized by the pair of first outer surface portions 262-1 and 262-2. Since each metal fitting is configured to perform the power supply connection at two positions in a direction perpendicular to the longitudinal direction of the connector, it is possible to enhance the fitting holding force against oblique extraction of the plug connector 200.

While this invention has been described with reference to the preferred embodiment, this invention is not limited thereto. Various variations that can be understood by those skilled in the art can be made to the structures and details of this invention within the spirit and scope of this invention described in the claims.

For example, although the springiness is imparted to the inner surface portions 132-1 and 132-2 on the receptacle metal fitting 130 side in the above-mentioned embodiment, the springiness may be imparted to the second outer surface portions 263-1 and 263-2, adapted to face the inner surface portions 132-1 and 132-2, on the plug metal fitting 260 side.

A plug connector and a receptacle connector of this invention can also be applied to use as connectors adapted to be mounted in various electronic devices for use in connection of boards such as printed boards, FPCs (flexible printed circuits), or the like.

DESCRIPTION OF SYMBOLS

100 receptacle connector
101 fitting frontage portion (to-be-guided portion)
110 receptacle housing (second housing)
111 bottom wall
112 projecting wall portion
113 outer peripheral wall
114 side wall
115 end wall portion
116 receiving space
120 receptacle terminal (second contact)
130 receptacle metal fitting (second metal member)
131 upper surface portion
132-1, 132-2 inner surface portion
133 end surface portion
133-1, 133-2 outer surface portion
135-1, 135-2 projection
200 plug connector
240 plug housing (first housing)
241 bottom wall
243 outer peripheral wall
244 side wall
245 end wall portion (guide portion)
246 receiving space
250 plug terminal (first contact)
260 plug metal fitting (first metal member)
261 upper surface portion
262-1, 262-2 first outer surface portion (outer surface portion)
263-1, 263-2 second outer surface portion (outer surface portion)
263-1A, 263-2A projection
264 end surface portion

The invention claimed is:

1. A connector assembly comprising a plug connector and a receptacle connector adapted to be fitted to each other along a connector fitting direction, wherein the plug connector comprises a plurality of first contacts, a first housing holding the plurality of first contacts arranged along a terminal arrangement direction, and a first metal member disposed outside an arrangement range of the plurality of first contacts in the first housing, wherein the first housing comprises a guide portion outside the arrangement range of the plurality of first contacts and the first metal member is attached to the guide portion, wherein the first metal member covers at least parts respectively of an upper surface in the connector fitting direction of the guide portion and three outer surfaces of an end wall portion of the guide portion, wherein the receptacle connector comprises a plurality of second contacts, a second housing holding the plurality of second contacts arranged along a terminal arrangement direction, and a second metal member disposed outside an arrangement range of the plurality of second contacts in the second housing, wherein the second housing comprises a to-be-guided portion outside the arrangement range of the plurality of second contacts and the second metal member is attached to the to-be-guided portion, the to-be-guided portion being adapted to be fitted to the guide portion and being formed by a wall of a U-shape as seen in the connector fitting direction, and wherein the second metal member comprises an upper surface portion for covering an upper surface in the connector fitting direction of the to-be-guided portion and a pair of outer surface portions and a third outer surface portion extending in the connector fitting direction from the upper surface portion for covering two outer surfaces of the wall of the U-shape.

2. The connector assembly according to claim 1, wherein the first metal member has an upper surface portion for covering the upper surface of the guide portion, a pair of outer surface portions extending in the connector fitting direction from the upper surface portion for covering two outer surfaces, on the sides opposite to each other, of the end wall portion of the guide portion, and an end surface portion extending in the connector fitting direction from the upper surface portion for covering an outer end surface of the end wall portion of the guide portion.

3. The connector assembly according to claim 1, wherein the second metal member further comprises a pair of inner surface portions for covering the two inner surfaces, facing each other, of the wall of the U-shape and an end surface portion extending in the connector fitting direction from the upper surface portion for covering an outer end surface of the wall of the U -shape.

4. The connector assembly according to claim 2, wherein the pair of outer surface portions of the first metal member comprise a pair of first outer surface portions extending in the connector fitting direction from the upper surface portion at a position close to the arrangement range of the plurality of first contacts in the terminal arrangement direction of the plug connector and a pair of second outer surface portions extending in the connector fitting direction from the upper surface portion at a position close to the end surface of the end wall portion in the terminal arrangement direction of the plug connector, and wherein the pair of second outer surface portions face the pair of inner surface portions of the second metal member when the guide portion is fitted into the to-be-guided portion.

5. The connector assembly according to claim 4, wherein the pair of inner surface portions of the second metal member each have springiness and each have a projection protruding on its surface side and wherein the pair of second outer surface portions of the first metal member have projections that are adapted to engage with the projections to lock a state of fitting of the guide portion into the to-be-guided portion.

6. The connector assembly according to claim 4, wherein the pair of first outer surface portions of the first metal member and the pair of outer surface portions of the second metal member are terminals for power supply connection, respectively.

* * * * *